US006062891A

United States Patent [19]

Villiers

[11] Patent Number: 6,062,891

[45] Date of Patent: May 16, 2000

[54] ELECTRICAL CONNECTOR WITH PULL RELEASE

[75] Inventor: Gerard Villiers, Vanves, France

[73] Assignee: Framatome Connectors International, Courbevoie, France

[21] Appl. No.: 09/134,669

[22] Filed: Aug. 17, 1998

[30] Foreign Application Priority Data

Aug. 18, 1997 [FR] France ..... 97 10428

[51] Int. Cl.[7] ..... H01R 4/50; H01R 13/625

[52] U.S. Cl. ..... 439/348

[58] Field of Search ..... 439/348, 258

[56] References Cited

FOREIGN PATENT DOCUMENTS

| | | |
|---|---|---|
| 0 532 955 A2 | 3/1993 | European Pat. Off. . |
| 2 570 554 A1 | 3/1986 | France . |
| 2 690 569 | 10/1993 | France . |
| 1 465 486 | 9/1969 | Germany . |

OTHER PUBLICATIONS

French Search Report.

*Primary Examiner*—Neil Abrams
*Assistant Examiner*—Javaid Nasri
*Attorney, Agent, or Firm*—Perman & Green, LLP

[57] ABSTRACT

The electrical connector comprises a base A having a body (1) with a front tubular skirt (2) in which is held at least one ball that can be radially displaced and a pin having a body (4) that can be inserted in the skirt and having at least one imprint for receiving the ball. The pin also has a locking ring (6) repelled axially on the body towards [from?] a front stop position and a ball driver ring (7) radially interposed between the body of the pin and the locking ring, having a sliding keying with the locking ring and having an inner diameter such that it holds the ball inside when it [the ring] covers it [the ball]. A sleeve (24) has a sliding keying with the pin body. A first elastic means, interposed between the pin body and the sleeve, pushes the sleeve towards a ratcheted position with the ball driver ring. A second elastic means, interposed between the sleeve and the ball driver ring, tends to move them apart from one another.

6 Claims, 2 Drawing Sheets

ELECTRICAL CONNECTOR WITH PULL RELEASE

The present invention concerns electrical connectors that can be locked by pushing and unlocked by pulling on a locking ring of one of the connector elements. Numerous electrical connectors of this type are known, which have the advantage of being able to be coupled and uncoupled by a simple linear movement.

In particular, document FR-A-2,690,569 describes such an electrical connector comprising:

- a base having a body with a front tubular skirt in which at least one ball is held and can be radially moved between an outer position where it projects with regard to the outer wall of the skirt and flush with the inside and an inner position where it projects with regard to the inner wall of the skirt and is flush with the outside, and
- a pin having:
  - a body that can be inserted in the skirt and having at least one reception imprint for the ball, the body of the pin preventing the ball from coming into the inside position, except when it is completely inserted in the skirt and thus presents its imprint facing the ball,
  - a locking ring that can be axially displaced on the body towards a position in front of the stop, towards which it is repelled by elastic means starting from this front stop position,
  - a ball driver ring radially interposed between the body of the pin and the locking ring, having a keying sliding with the locking ring, which can be axially displaced with regard to the locking ring towards a front position towards which it is repelled by elastic means starting from this front position against the action of said elastic means, said ball driver ring having an inner diameter so that it keeps the ball in an inner position when the ring covers the ball.

The terms "base" and "pin" are used for reasons of convenience. It does not at all imply that the base is fixed in a permanent manner, although in general it belongs to a fixed device, while the pin is connected to a cable.

One of the modes of embodiment described in the document already cited permits coupling the connector by holding the pin either by the body, or by the locking ring, which facilitates insertion. But for this, it uses two catches which are alternatingly taken up during the insertion operations. At a given instant, during insertion, neither of the two catches is engaged, which creates uncertainty. In the majority of cases, this is not a disadvantage, but it is desirable to eliminate it for applications that require great security.

The present invention notably seeks to provide an electrical connector of the type described above, keeping all the advantages that can be thus obtained but without having its disadvantages.

For this purpose, the invention notably proposes an electrical connector characterized in that said elastic means comprise:

- a sleeve having a keying sliding with the body of the pin,
- a first elastic means interposed between the body of the pin and the sleeve and pushing said sleeve towards the front of the pin, towards a catching position with the ball driver ring,
- a second elastic means interposed between the sleeve and the ball driver ring and tending to move the sleeve from the catching position with the ball driver ring, the force exerted by the first means being greater than that exerted by the second.

In order to reduce the diameter of the connector, the elastic means can be made up of pincher springs, having bent arms so as to be able to place these springs in a narrow annular space inside the locking ring.

In order to facilitate its production, the ball driver ring can be made up of several assembled parts, as well as the sleeve.

The above characteristics as well as others will appear more clearly upon reading the description that follows of a particular mode of embodiment, given by way of non-limiting example. The description refers to the drawings that accompany it, in which.

Figure 1:
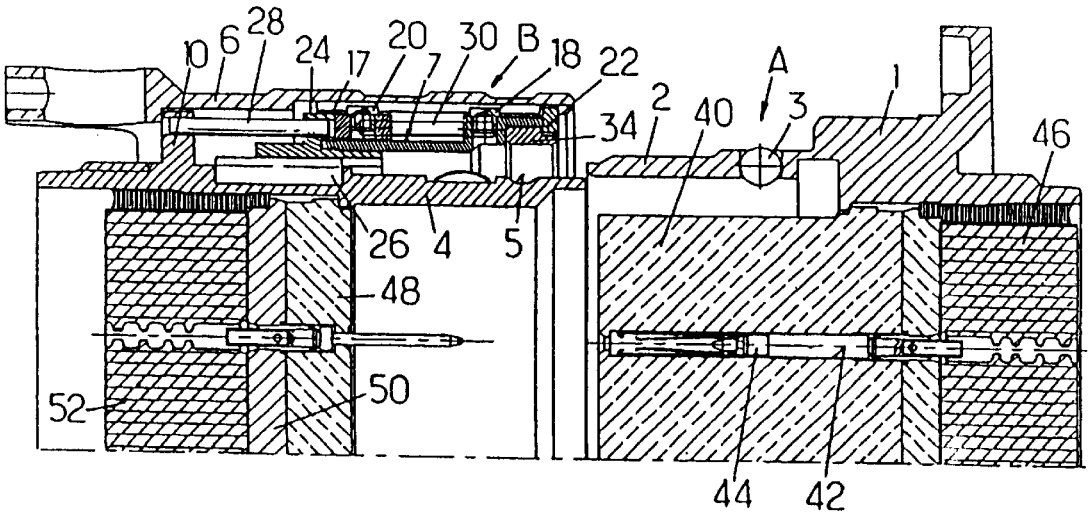
FIG. 1 shows a connector according to a particular mode of embodiment of the invention, in the uncoupled state, in section along a plane passing through the axis.
Figure 4:
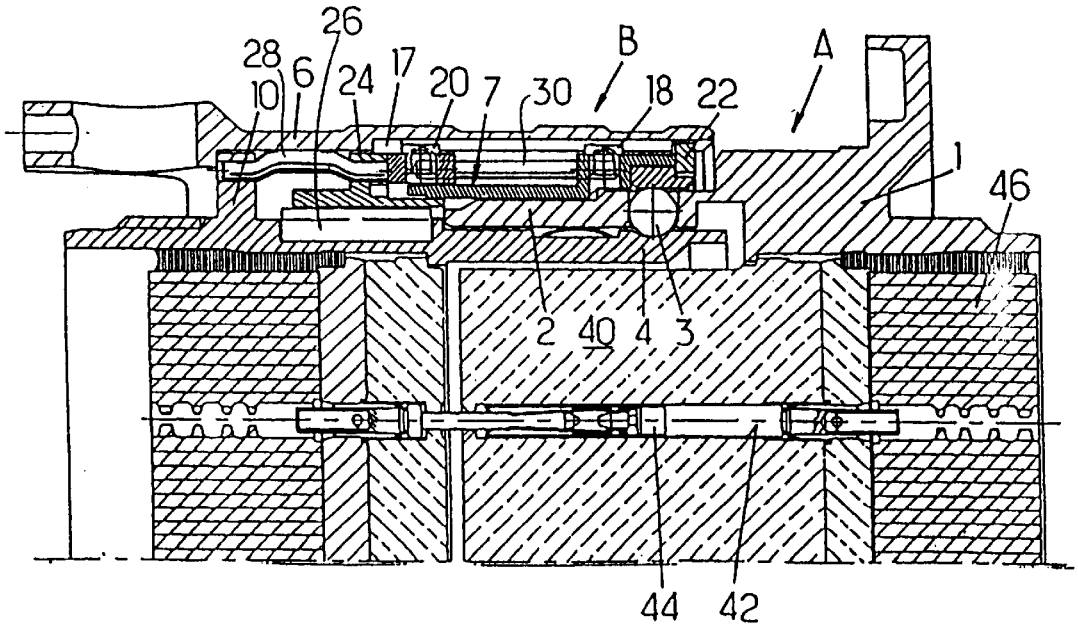
Figure 5:
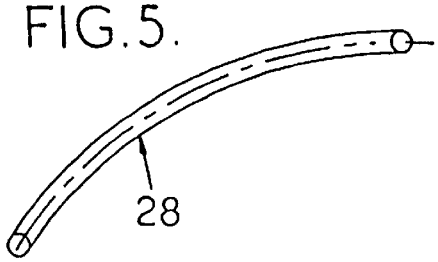
Figure 6:
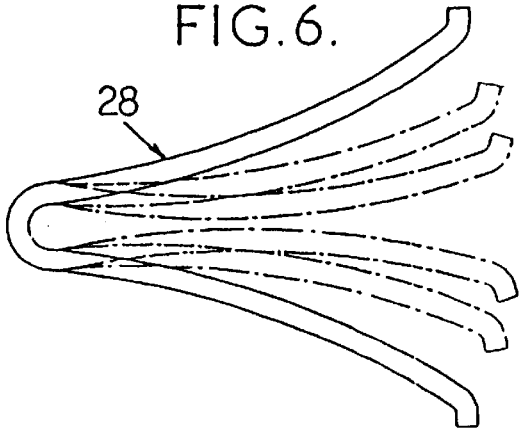

FIG. 4, similar to FIG. 1, shows the connector in locked position;

FIGS. 5 and 6 show a pincher spring.

The connector shown in FIG. 1 is made up of a base A and a pin B.

Base A has a body 1 whose front part is made up of annular skirt 2 having a revolving shape. An insulator 40 is immobilized in the body, pierced with passages 42 for receiving contact terminals 44. The rear of the body contains a wire passage 46 in which are arranged passage holes for the conductors coupled to terminals 44.

Radial holes are introduced in skirt 2, numbering three, for example, regularly distributed in the circumferential direction. A crimping, not shown, allows the balls 3 to move only between an inner position in the radial direction, shown in FIG. 1, and an outer position in the radial direction, shown in FIGS. 3 and 4.

Pin B also has a body 4 that also contains an insulator 48 held in place by a plate 50 and a wire passage 52, bearing male terminals. The front part of this body is also tubular and revolving. It is provided to be engaged with slight play in skirt 2.

An annular groove 5 is arranged in the outer wall of pin body 4, positioned so that it faces balls 3 when the connector is in a fully engaged position (FIG. 4).

Pin body 4 has a flange 10 resting on an inner shoulder of a locking ring 6. Flange 10 thus limits the movement of locking ring 6 towards the front with regard to pin body 4. The movement towards the rear of the ring is limited by means that will be described later.

A ball driver ring 7 is positioned in the radial space between pin body 4 and locking ring 6. Ball driver ring 7 is kept from rotating relative to locking ring 6 by sliding keying means, for example, having longitudinal grooves 17, arranged on the inner surface of the locking ring, and keys 18 and 20 belonging to the ball driver ring, which keys engage in the grooves. Movement towards the front of ball driver ring 7, relative to locking ring 6, is limited by its abutting against a stop 22 that can be made up of a circlip imprisoned in a circumferential groove of the locking ring.

The ball driver ring is completed by a guiding socket 19 mounted with gentle friction on it and also provided with keys 20. Elastic means tend to push ball driver ring 7 towards stop 22 and locking ring 6 towards its position of rest against flange 10.

The elastic means comprise a sleeve that also has for a role to immobilize the locking ring from rotation as long as the connector is not locked and to then release it to provide a tactile indication of locking.

Sleeve 24 is mounted on body 4 and presents a slide keying, made up, for example, of an inner groove or grooves of the sleeve and one or more key(s) 26 mounted on the body. A first spring 28, shown in FIG. 1 by a double arrow, is interposed between flange 10 and the sleeve. It tends to push the sleeve towards the front. A second spring, diagrammed by a double arrow 30, tends to move sleeve 24 and ball driver ring 7 apart from one another. In the case illustrated in the figures, ball driver ring 7 is made up of several pieces. It comprises the ring 7 itself, to which is attached key 18 and socket 34 mounted with gentle friction on ring 7 itself, provided with key or keys 20.

Springs 28 and 30 are advantageously pincher springs of curved shape, being able to have, for example, the appearance shown in FIGS. 5 and 6. The curvature of the arms (FIG. 5) roughly corresponds to the average radius of the annular space in which it is lodged. At rest, the springs can have a shape of the type shown by the solid lines in FIG. 6. When they are subjected to a force, they take a shape of the type shown by dashes in this FIG. 6. Given that they are mounted between the solid rotating elements, they can have anchoring projections in the elements that they separate.

When sleeve 24 and ball driver ring 7 itself are in mutual support (FIGS. 1, 2 and 3), they are ratcheted so as to prevent them from turning with regard to one another. In the case illustrated, this ratcheting is made up of two sets of teeth or projections, one arranged on the rear section of ball driver ring 7, the other at the bottom of an annular cavity arranged in the sleeve and designed to receive the rear end of the ball driver ring. Spring 30 is interposed between ball driver ring 7 and socket 19, which holds it in contact with sleeve 24.

The ball driver ring can be comprised of two pieces, one having keys 18 and ratcheted onto the sleeve, the other reduced to a collar 34 supported on balls 3.

The different elements that have just been described are dimensioned in such a way that the operation is the following:

In order to couple the pin and the base starting from the position where they are shown in FIG. 1, it is sufficient to push pin B either by body 4, or by ring 6, which then rests on flange 10.

Figure 2:
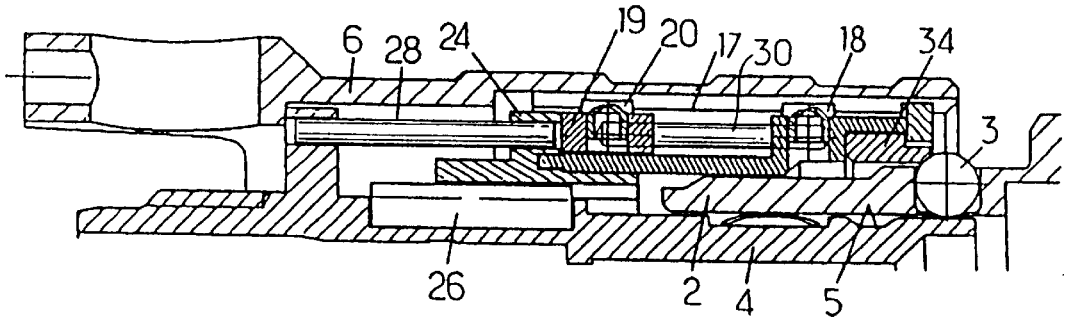
FIG. 2 is a detail view in enlarged scale showing the connector elements in the position that they occupy when the ball driver ring comes into contact with the ball.

The relative arrangement of the components of the pin remains the same until the ball driver ring comes into the position of support against balls 3 shown in FIG. 2. Locking ring 6 is always prevented from rotating, given its sliding keying with ball driver ring 7, itself ratcheted onto sleeve 24, which is in turn keyed onto the body. Error preventing means, not shown, are generally provided on the pin body and the base body in order to allow the introduction of the pin only in the suitable orientation.

Figure 3:
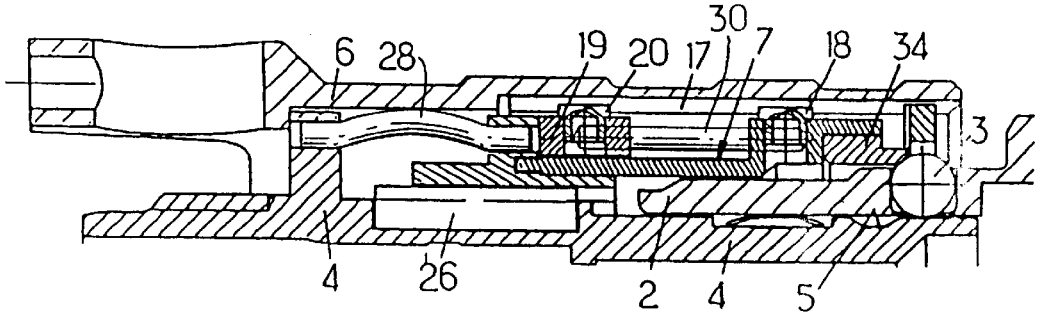
FIG. 3 is a detail view showing the arrangement taken by the different elements when the pin body has advanced relative to the position shown in FIG. 2.

When one continues to push locking ring 6 towards the front, which drives pin body 4, ball driver ring 7 recoils in the axial direction, since the balls cannot be radially pushed in (FIG. 3). Locking ring 6 remains prevented from rotating.

It is the same if one exerts the insertion force on the pin body instead of exerting it on the locking ring, except the locking ring can then recoil at the same time as the ball driver ring, When pin body 4 has sufficiently advanced for the balls to be opposite imprints 5, the balls disappear towards the inside under the pressure of ball driver ring 7, on which the pressure of spring 28 is exerted, transmitted by sleeve 24. The sleeve is dimensioned so that its advance is limited by coming to abut against stop 22 of one piece with locking ring 6, itself blocked by flange 10 (FIG. 4). Spring 30, weaker than spring 28, is then released and projects the ball driver ring 7 forwards which rotationally separates the ring 7 from the sleeve. Ball driver ring 7 is then once again supported against stop 22. The balls cannot escape, even in the case of a pulling exerted on the pin body. The locking ring is released to rotate and provides a confirmation of the locked state.

Unlocking is effected by pulling locking ring 6 towards the rear. The locking ring drives the ball driver ring, which releases the balls. The locking ring can only recoil with regard to the body until it causes sleeve 24 to abut against flange 10. Once the pin is released, it is sufficient to release the locking ring so that the pin elements return to the position shown in FIG. 1.

The locking ring is then once again prevented from rotating with regard to the body.

The arrangement that has just been described permits filling the same functions as those of more complex and cumbersome connectors of the prior art. The projection of the locking ring towards the front by a spring guarantees a true locking. At no time is there uncertainty with regard to the catching of the locking ring.

What is claimed is:

1. An electrical connector comprising:

a base (A) having a body (1) with a front tubular skirt (2) in which is held at least one ball that can be radially displaced between an outer position where it projects with regard to an outer wall of the skirt and is flush on an inside surface thereof and an inner position where it projects with regard to an inner wall of the skirt, a pin having a body (4) that can be inserted in the skirt and having at least one reception imprint for the ball, a locking ring (6) axially displaceable on the body towards a position in front of a stop, towards which position the locking ring is repelled by elastic means, a ball driver ring (7) radially interposed between the body of the pin and the locking ring, having a keyed sliding connection with the locking ring, which ball driver ring being axially displaceable relative to the locking ring towards the front position from which it is repelled by said elastic means against the action of said elastic means, said ball driver ring having an inner diameter such that it keeps the at least one ball in an internal position when the ring covers the ball, characterized in that said elastic means comprise:

a sleeve (24) coaxially disposed with said ball driver ring (7) having a sliding keying with pin body (4), a first elastic means (28) interposed between pin body (4) and said sleeve (24) and pushing said sleeve towards a ratcheted position with said ball driver ring (7), a second elastic means (30) interposed between said sleeve (24) and said ball driver ring (7) and tending to move the sleeve away from the ratcheted position, the force exerted by the first elastic means (28) being greater than that exerted by the second elastic means (30).

2. The connector according to claim 1, further characterized in that the first and second elastic means are made up of pincher springs, having curved arms so that the springs occupy a narrow annular space inside the locking ring.

3. The connector according to claim 2, further characterized in that the second elastic means (30) is placed between said ball driver ring and a socket (19) keyed in a sliding manner on locking ring (6) held against the sleeve by said first and second elastic means (28, 30).

4. The connector according to claim 3, further characterized in that the second elastic means has terminal anchoring projections on the socket and the ball driver ring.

5. The connector according to claim 1, further characterized in that the ball driver ring is made up of two pieces, one having keys (18) for keying onto the locking ring and ratcheting onto the sleeve, the other reduced to a ring (34) resting on balls (3).

6. The connector according to claim 1, further characterized in that the ratcheting is made up of two sets of teeth or projections, one arranged on a rear section of the ball driver ring (7), the other at a bottom of an annular cavity arranged in the sleeve and designed to receive the rear end of the ball driver ring.

* * * * *